US005298877A

United States Patent [19]

Gurevich et al.

[11] Patent Number: 5,298,877

[45] Date of Patent: Mar. 29, 1994

[54] FUSS LINK AND DUAL ELEMENT FUSE

[75] Inventors: Leon Gurevich, Grover; Edward Haworth, Chesterfield, both of Mo.

[73] Assignee: Cooper Industries, Inc., Houston, Tex.

[21] Appl. No.: 20,101

[22] Filed: Feb. 19, 1993

[51] Int. Cl.[5] ..... H01H 85/04

[52] U.S. Cl. ..... 337/164; 337/163; 337/290; 337/295

[58] Field of Search ..... 337/161, 162, 163, 164, 337/165, 166, 290, 295, 401, 416, 405

[56] References Cited

U.S. PATENT DOCUMENTS 2,787,684 4/1957 Laing ..... 337/164

4,417,224 11/1983 Ross ..... 337/164

*Primary Examiner*—Harold Broome

*Attorney, Agent, or Firm*—Laff, Whitesel, Conte & Saret

[57] ABSTRACT

We provide ah overload fuse link that is generally used in cartridge type fuses along with a short-circuit fuse link. The overload fuse link is prepared from a solder alloy and is directly attached to the interior of one of the cartridge fuse terminals. The overload fuse link has an open bore opening at one end and a connector extending from the other end. The cartridge fuse which uses the fuse link also has an insulator through which the connector passes and the insulator separates the short circuit fuse link from the body section of the overload fuse link wherein when there is an overload, the fuse link connector electrically separates from the fuse link body section.

15 Claims, 3 Drawing Sheets

Fig. 5
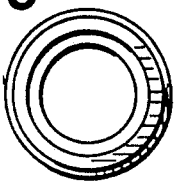
Fig. 8
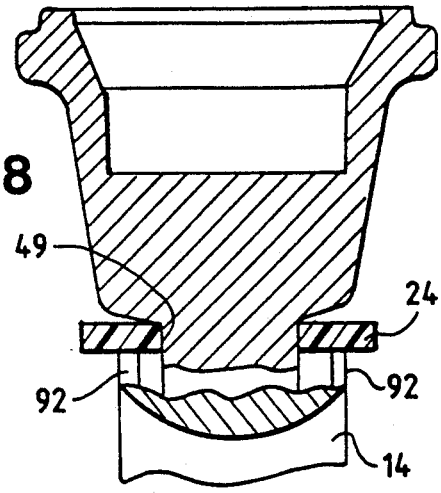
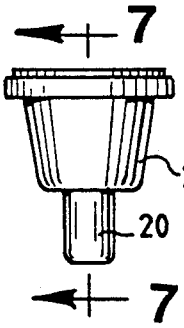
Fig. 4
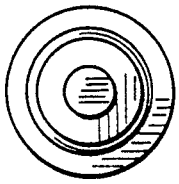
Fig. 6
Fig. 9
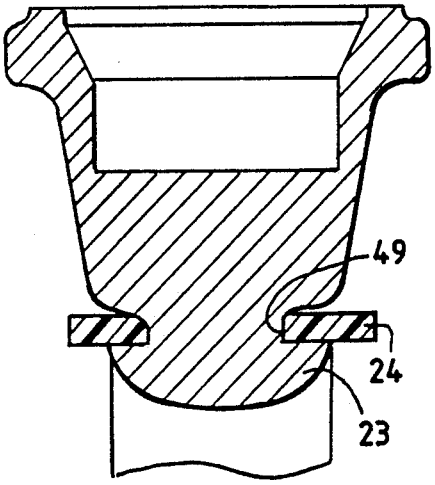
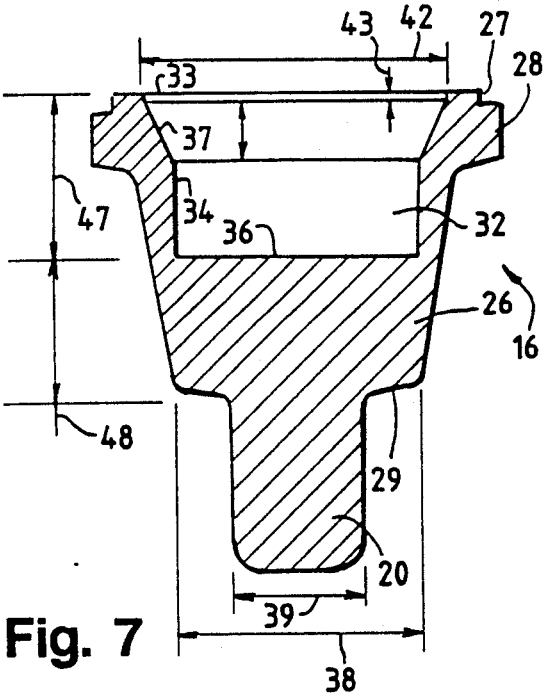
Fig. 7

Fig. 10
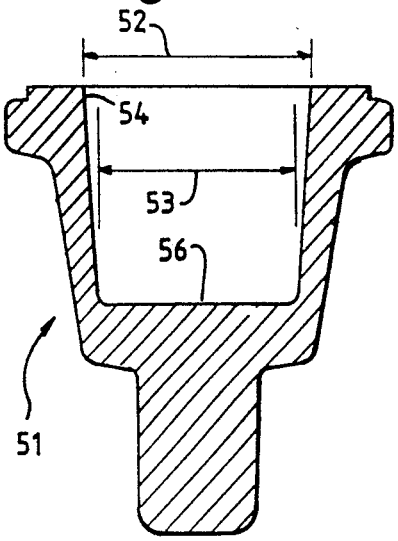
Fig. 12
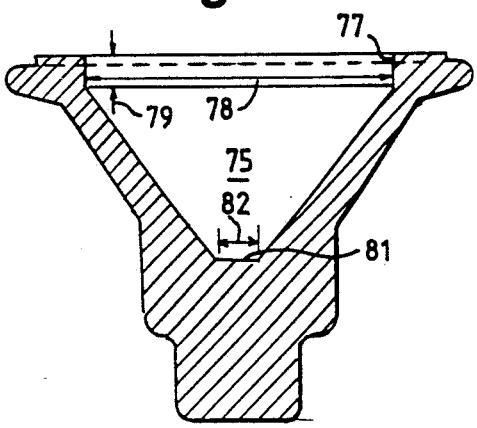
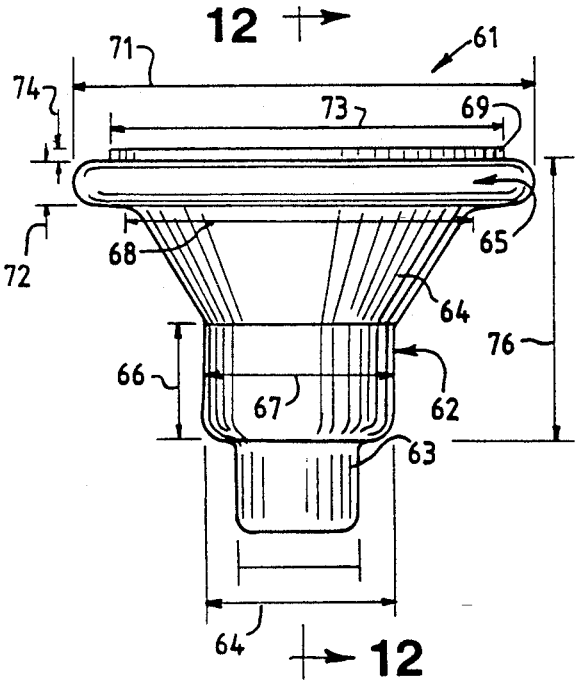
Fig. 11
Fig. 14
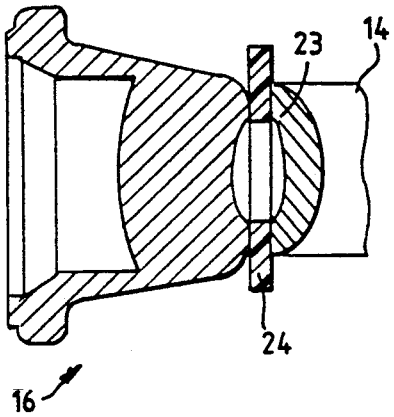

FUSS LINK AND DUAL ELEMENT FUSE

FIELD OF THE INVENTION

The present invention relates to an overload fuse link and dual-element fuses that use the overload fuse link and more particularly, to an overload fuse link having a bore or open chamber.

BACKGROUND OF THE INVENTION

As is well known, there are many examples of dual-element fuse links with at least one of the elements being utilized to open the fuse when there is a short circuit and another element being utilized to open the fuse when there is an overload.

The dual-element fuse normally has a mass of heat-softenable alloy which is in contact with a heat-absorbing element so that the softening of the mass of heat softenable alloy is delayed to provide a desired-predetermined, time-delay before the electric fuse responds to a relatively low, but potentially-harmful over current to effect opening of the circuit.

In some instances, the overload fuse portion is operated by a spring so that when the heat softenable material melts, the spring quickly opens the circuit. In these instances, the overload fuse element is usually maintained in air and is separated from any quartz sand or other material which is in the fuse element.

In other time delay fuses, the overload current is provided by a solid mass which is surrounded by sand. The sand acts as a heat conductor and allows the solid mass to melt. However, in such an instance, there are many times when the fuse does not blow due to the melting mass and sand acting as a conductor. These types of fuses are shown in U.S. Pat. No. 4,417,224, the Aeroflex Publication, U.S. Pat. No. 4,973,932. The reliability of these types of fuses while generally acceptable, still need improvements.

SUMMARY OF THE INVENTION

In view of the above, it is an object of this invention to provide a dual-element fuse which is capable of operating to interrupt high level currents and will respond to both large overloads and small overloads.

It is further an object of the present invention to provide a one-piece alloy overload fuse link having a body with an opening at one end and a fuse link connector extending from the other end of the body, a bore formed in the body, the bore having an open end and a closed end, the body opening forming the bore open end formed in the body wherein when there is an overload current the fuse link connector separates from the fuse link body.

It is still another object of the present invention to provide a cartridge fuse having a solder alloy overload fuse link with the overload fuse link having a body with an upper section and a body section, the upper section being electrically attached to said first terminal, an open bore formed in the body section and extending through the upper section with the opening facing a first terminal and being spaced from the first terminal, an insulator inside cartridge separating the body section from a short circuit fuse link, a fuse link connector extending from the body section through the insulator towards a second terminal and the said short circuit fuse link end electrically attached to the fuse link connector wherein when there is an overload current, the fuse link connector electrically separates from the body section.

A further object of the present invention is to provide a cartridge fuse having a solder alloy overload fuse link, the overload fuse link having a body with an upper section and a body section, the upper section being electrically attached to a first terminal, an insulator inside the cartridge separating the body section from the short circuit fuse link. A fuse link connector extending from the body section through the insulator towards a second terminal and the short circuit fuse link end electrically attached to the fuse link connector wherein when there is an overload current, the fuse link connector electrically separates from the body section.

Therefore, we provide an open interior overload fuse link which has an outer shell. The overload fuse link is usually prepared by casting or molding a mass of heat-softenable alloy. The fuse link is preferably structured so that there are no cross-sectional weak spots. The fuse link has a body section and a short circuit fuse connector section. The fuse link is constructed such that when there is an overload current, a portion of the heat-softenable material of the connector section is melted and separated from the body section to open the circuit. With this action, solder tends to be drawn into the interior.

BRIEF DESCRIPTION OF THE DRAWINGS

FIG. 4 is a side view of a fuse link according to the present invention.

FIG. 5 is a top plan view of the fuse link of FIG. 4.

FIG. 6 is a bottom plan view of the fuse link of FIG. 4.

FIG. 7 is an enlarged cross-section of the fuse link of FIG. 4 taken along lines 7—7;

FIG. 8 is a partial cross-section showing the link of FIG. 7 connected to a short circuit link;

FIG. 9 is another partial cross-section showing the link of FIG. 7 electrically attached to a short circuit link;

FIG. 10 is a cross-section showing another embodiment of the present invention;

FIG. 11 is a side of another overload fuse link according to the present invention;

FIG. 12 is a cross-sectional view of FIG. 11 taken along lines 12—12.

FIG. 14 is a partial cross-sectional view of the fuse link of FIG. 9 when it is blown.

DETAILED DESCRIPTION OF THE INVENTION

Figure 1:
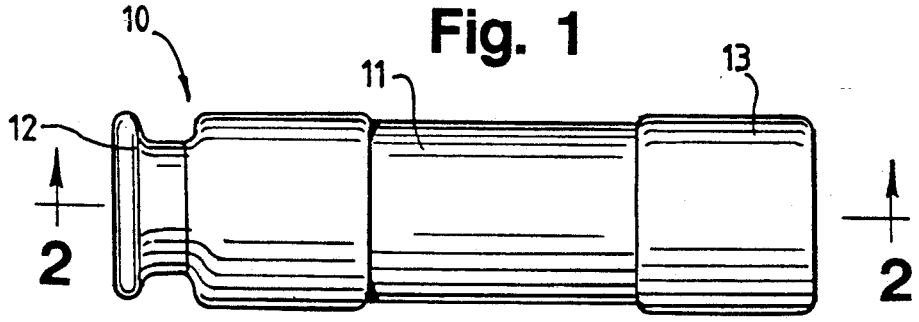
FIG. 1 is a side view of a cartridge fuse assembly according to the present invention.

Referring to FIG. 1, we show one preferred embodiment of the present invention which generally relates to a cartridge type time delay fuse 10. The fuse 10 is prepared to fulfill the UL-RK-5 standard 198E. The fuse has a tubular casing 11. The casing 11 is generally made from a heat resistant insulating material such as fiber, paper, glass melamine, or the like.

The casing 11 has on each end a ferrule-like terminal 12, 13 designed for the particular application. The ferrule terminals 12, 13 illustrated are generally made from copper or copper alloy. The ferrule terminals 12, 13 are dimensioned to telescope over the proximal and distal ends respectively of the tubular casing 11. After the ferrule terminals have been placed on the tubular casing ends, their ends may be notched to hold them onto the casing. If desired, the terminals can also be crimped to provide extra holding. The general external configuration for cartridge fuses such as 10 as shown in FIG. 1 is well known and relatively conventional.

Figure 2:
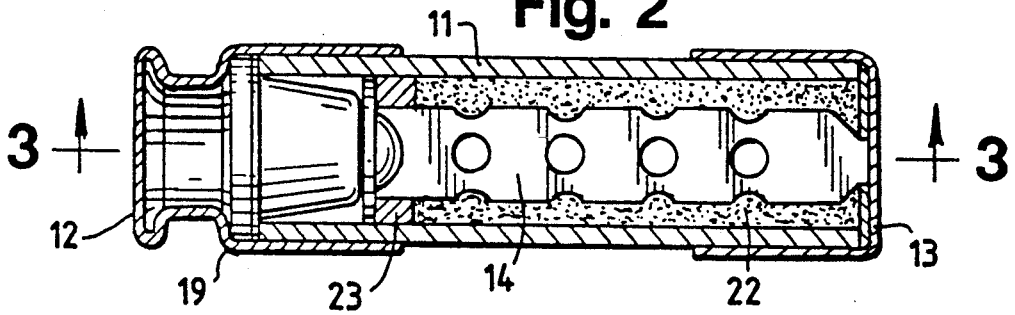
FIG. 2 is a partial cross-sectional view of the cartridge assembly of FIG. 1 taken along lines 2—2.
Figure 3:
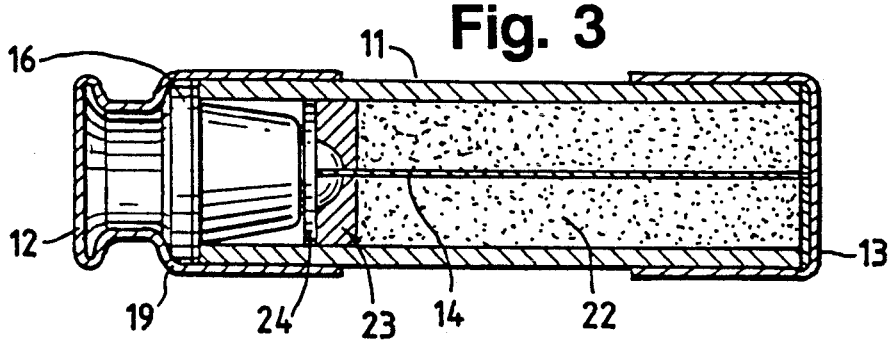
FIG. 3 is a partial cross-section view of the fuse cartridge assembly of FIG. 2 taken along lines 3—3.

FIGS. 2 and 3 show a partial cross-sectional view of the cartridge fuse illustrating the positioning of the dual element fuse link of the present invention. The dual element fuse link has one short circuit ribbon-like fuse link 14 and an open interior overload fuse link 16.

A washer 18 is electrically connected to one end of the fuse link 14. The washer 18 is soldered or appropriately connected to the inner surface of the terminal 13 to electrically connect the fuse link section 14 to the terminal 13.

One end of the fuse link 16 is directly and electrically attached to the terminal 12 placing an appropriate flux on the appropriate annular interior section of terminal 12 as indicated by numeral 19 and then heating the exterior of terminal 12 to solder at 19 the proximal end of fuse link 16 to the inner surface of the terminal 12. We are not aware of any prior cartridge fuse which attaches the overload solder alloy fuse link directly to the fuse terminal.

The other end of the fuse link 16 has a rod-like connector 20. The connector passes through an insulating washer 24. The washer 24 separates the body 26 of the overload fuse link 16 from the short circuit fuse link 14. The distal end 23 of the connector forms a button type rivet connection with the washer 24. That is, the connector end 23 has a diameter larger than the diameter of the hole in the washer. The washer 24 has an outer diameter substantially equal to the inner diameter of the cartridge tube. The washer 24 is prepared from any suitable electrical insulating composition, i.e. fiber, thermoplastic, glass, ceramic and rubber.

Although we describe the use of an insulating washer, any type of insulator, i.e., a cap, can be used which has a hole therethrough to permit the passage of the connector 20 and separates the fuse body 26 from the short circuit fuse link 14.

A wax or similar insulating composition 21 surrounds the distal end 23 of the fuse link and substantially separates the fuse link 16 from the appropriate filler 22, i.e, quartz sand. The wax composition is generally any appropriate insulating composition which has a melting point of above 90° c. i.e. Fisher/Tropsch was supplied by Frank B. Boss, Co.

The washer 24 acts as a base for the wax composition 21 and an abutment or base for the end of the short circuit fuse link 14.

The cartridge is filled with an appropriate filler 22, i.e, quartz sand. The sand contacts only the fuse link 14. When the fuse link 16 is in the environment illustrated in FIGS. 2 and 3, the wax composition protects the fuse link 16 from being contacted by the filler.

FIGS. 4 to 8 show the preferred fuse link 16 for a 250 volt, 30 amp fuse. The fuse link 16 is an open cone-type structure.

The 250 volt 30 amp fuse is generally 2 inches (50.8 mm) long having an outer diameter of approximately ½ inch (12.7 mm). The fuse link 16 prior to being connected to the link 14 has a fuse link body 25 with a generally frustro-conical body section 26, a proximal open annular end 27 and an annular flange 28 formed at the conical base of body section 26. A rod-like fuse link connector 20 extends concentrically from the frustro apex end 29.

A bore 32 is formed in the fuse link 16. The bore 32 has a first cylindrical section 33 having the largest diameter of the bore 32 which opens at the end 27, a smaller substantially cylindrical section 34 having a closed end 36, and a connecting frusto-conical section 37 connecting sections 33 and 34.

In the 250 volt 30 amp link 16, the apex diameter 38 is about 0.30 inches (7.62 mm); the diameter 39 of the short circuit link connecting section 20 is about 0.164 inches (4.17 mm); the proximal end of the link 16 has an outer diameter 41 of about 0.45 inches (11.43 mm) and a concentric bore inner diameter 42 of about 0.375 inches (9.53 mm). The first cylindrical bore section has a depth or height 43 of about 0.01 inches (0.25 mm). The second frustro-conical bore section 37 has a depth or height 44 of about 0.073 inches (1.85 mm) and the third cylindrical bore section has a depth or height 46 of about 0.121 inches (3.07 mm). The overall height or depth 47 of the bore is about 0.204 inches (5.18 mm) . The overall height 48 of the fuse link body 26 is about 0.370 inches (9.4 mm).

Referring to FIG. 8, the cylindrical fuse link connector rod 20 has a slightly tapered and rounded end. The insulating washer 24 has a hole 49 which has a diameter substantially equal to the diameter 39 of the rod so as to fit on the rod 20 and remain on the rod adjacent the end 29 without falling off. The proximal end of the fuse link 14 is pressed into the rod 20 until the ends of the fuse link abuts one side of the washer 24. Then the rod 20 is heated to fuse it to the link 14 and provide the rivet button 23 (FIG. 9) which further locks the fuse link 16 onto the washer and the fuse link 14.

Referring to FIG. 10, there is shown a fuse link 51 which is generally the shape of an overload fuse for 2 by ½ in. cartridge fuse having a rating of 250 volt 15 amp. For this fuse link, the bore is a frusto-conical bore having an open end diameter 52 of about 0.302 inches (7.67 mm) and a frusto apex diameter 53 of about 0.264 inches (6.71 mm). The height or depth of the frustro-conical bore 54 is about 0.288 inches (7.32 mm). The closed end 56 of the bore is slightly inclined as shown. The outer appearance of the overload link 51 is substantially the same as overload link 16.

Referring to FIG. 11, there is shown an overload fuse link 61 for a cartridge fuse rated at 600 volt and 30 amp. The fuse link 61 has a body 62. The body 62 has a lower cylindrical body section 63, a frustro-conical midsection 64, and an upper flange section 65 and an annular open end section 69. The lower body section has a height 66 of about 0.20 inches (5.08 mm) inches and a diameter 67 of about 0.30 inches (7.62 mm) . The frustro-conical body section 64 diverges from the lower section 63 to the flange 65. The outer diameter 68 connecting to the flange is about 0.538 inches (13.67 mm). The flange 65 has an outer diameter 71 of about 0.724 inches (18.39 mm) and a depth or height 72 of about 0.066 inches (1.68 mm). The annular end 69 has an outer diameter 73 of about 0.662 inches (16.76 mm) and a depth or height 74 of about 0.020 inches (0.51 mm). The overall height 76 of the link body 62 is about 0.435 inches (11.05 mm).

Referring to FIG. 12, the fuse link 61 has an internal bore 75 with a top cylindrical section 77 that has a diameter 78 of about 0.50 inches (12.70 mm) and a depth or height 79 of about 0.10 inches (2.54 mm). The bore closed end 81 has a diameter 82 of about 0.15 inches (3.81 mm).

The bore 75 diverges from the closed end 81 to the cylindrical section 77. The overall height or depth of the bore is about 0.30 inches (7.62 mm).

The overload fuse link of the present invention has a bore which extends at about 30 to 85% of the height of the fuse link body and has an opening in the fuse link with a diameter which is larger than the diameter of the hole in the insulating washer which is to be attached to the fuse. The volume of the fuse link bore is at least 25% of the volume of the fuse body.

The solder alloy used to produce the hollow fuse links preferably is eutectic with a narrow melting point band of up to 8° C. The melting point of the solder is from about 80° C. to about 140° C. with about 98° C. being preferred for the fuse link 16. The solder is electrically conductive, has low electrical resistance. The solder is preferably an indium, bismuth, antimony, zinc, lead, cadmium or tin based solder with tin, bismuth, antimony and zinc based eutectic solders being preferred. Also, the solder must be able to be molded or cast and not be brittle after casting and relatively neutral to casting expansion and also have low thermal expansion.

Alloys which have acceptable properties are the bismuth and tin alloys which contain from about 10 to about 70% by weight bismuth and from about 10 to about 70% by weight tin, from about 0 to 5% by weight zinc, and from about 10 to about 50% by weight lead.

A preferred solder alloy is one having about 52.5% by weight bismuth, about 15.5% by weight tin, and about 32% by weight lead.

Figure 13:
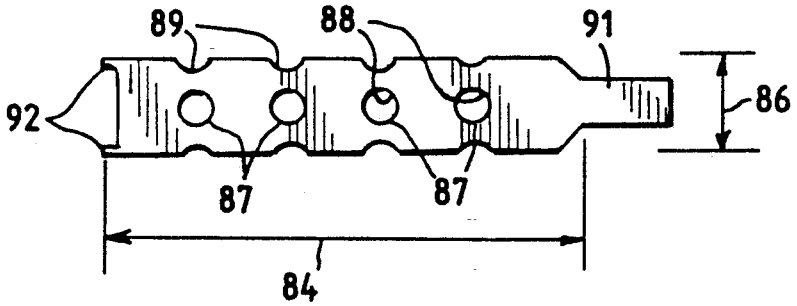
FIG. 13 is a side view of a short-circuit fuse link.

Referring to FIG. 13, the short circuit fuse link 14. The short circuit fuse link 14 has a length 84 and a width 86. The length 84 is at least three times the width 86. The link 14 has a plurality of weak spots 87 formed along the length thereof. The weak spots 87 are formed by the apertures 88 and partial apertures 89. The apertures 88 are spaced along the longitudinal axis of the link 14 and the partial apertures 89 at the top and bottom edges of the link 14. For each aperture 88 there is an aligned top and bottom partial aperture 89. The partial apertures 89 act to prevent or restrain the arc from running up or along the edge of the link.

On the proximal end of the fuse link 14 is formed an integral washer connector 91 which has a lesser width than the link 14. In operation, the connector passes through the washer 18 is bent to extend substantially perpendicular to the fuse link longitudinal axis. The washer 18 as noted above has a diameter that is larger than the internal diameter of the fuse tube 11 and is adapted to rest on the fuse tube. The diameter is less than or equal to the internal diameter of ferrule terminal 13.

The fuse link 14 is one piece and generally or substantially flat ribbon-like fuse link. The distal end of the fuse link 14 preferably has a pair of spaced stanchions or arms 92. When the short circuit fuse link 14 is attached to the overload fuse link 16, the arms space a major portion of the fuse link end, more than 65% of the fuse link width, away from the washer 24.

The short circuit fuse link 14 is designed to conduct heat to the overload fuse link 16. Therefore, the fuse links 14 has a generally high electrical resistance and a relatively high thermal conductivity and is made from the appropriate alloys. Appropriate alloys are copper alloys such as commercial bronze, copper-nickel or red brass.

Referring to FIG. 14, when there is an overload current, the short circuit fuse link 14 delivers heat to the fuse link connecting end 23. The heat causes the fuse link 16 to melt which causes solder to be drawn out of the washer hole 49 and as was analyzed on some fuse links, as shown in FIG. 14, spaced from the washer hole on both sides of the washer 24 to break the electrical connection between the fuse link 14 and 16. The insulating washer 24 separates the remaining portion of the fuse link end 23 from the fuse link body 26 to thus open the circuit. The wax 21 provides an insulating barrier to separate molten solder from the short circuit fuse link.

As shown in FIG. 14, a portion of the bore 32 is filled when the fuse link 16 separates itself from the washer hole 49.

Whereas the drawings and accompanying description has shown and described preferred embodiments of the present invention, it should be apparent to those skilled in the art that various changes may be made in the form of the invention without affecting the scope thereof.

The claimed invention is:

1. A one-piece alloy overload fuse link comprising a body having an opening at one end and a fuse link connector extending from the other end of said body, a bore formed in said body, said bore having an open end a closed end, said body opening forming the bore open end bore formed in said body wherein when there is an overload current said fuse link connector separates from said fuse link body.

2. The overload fuse link of claim 1 wherein said bore has a volume equal to at least 25% of the total volume of said fuse link body.

3. The fuse link of claim 1 wherein said bore has at least a portion thereof which is frusto-conical.

4. The fuse link of claim 2 wherein said bore has at least a portion thereof which is frusto-conical.

5. The fuse link of claim 4 wherein the bore has at least two sections with one section being substantially cylindrical.

6. The fuse link of claim 4 wherein the fuse link body has an upper flange which has a diameter greater than the inner diameter of a fuse cartridge and acts as a shoulder to rest on the fuse cartridge, a body section which tapers inwardly from the shoulder to provide a body section which has a diameter less than the inner diameter of said fuse cartridge, a substantially cylindrical fuse connector extending from the body section end opposite the flange end, said connector having a diameter less than the inner diameter of said fuse cartridge.

7. A cartridge fuse comprising:

a tubular casing, said tubular casing being an electrical insulating material, and said tubular casing having a proximal end and a distal end;

a first terminal attached to said proximal end of said tubular casing;

a second terminal attached to said distal end of said tubular casing;

a short circuit link having a first end and a second end, said first end being electrically attached to said second terminal;

a solder alloy overload fuse link, said overload fuse link having a body with an upper section and a body section, said upper section being electrically attached to said first terminal, an open bore formed in said body section and extending through said upper section with said opening facing said first terminal and being spaced from said first terminal;

an insulator inside said tubular casing separating said body section from said short circuit fuse link;

a fuse link connector extending f rom said body section through said insulator towards said second terminal; and said short circuit fuse link second end electrically attached to said fuse link connector, wherein when there is an overload current, said fuse link connector electrically separates from said body section.

8. The cartridge fuse of claim 7 wherein the fuse connector is integral with said overload fuse link, said connector and said overload fuse link are constructed from a solder having a melting point of from about 90° C. to about 150° C., and said bore has a volume equal to at least 25% of the total volume of said fuse link body.

9. The cartridge fuse of claim 8 wherein said open bore has at least a portion thereof which is frusto conical.

10. The cartridge fuse of claim 9 wherein the bore has at least a portion thereof being substantially cylindrical.

11. The cartridge fuse of claim 7 wherein said short circuit fuse link is ribbon-like having a width less than the inner diameter of said tubular casing;

said overload fuse link and connector are one-piece, said overload fuse link has an upper flange section, said flange section resting on the proximal end of the tubular casing, said flange section being electrically attached to said first terminal, said body section being spaced from the innerwalls of said tubular casing for a substantial length thereof;

said insulator is a washer having a diameter substantially equal to the inner diameter of said tubular casing, said washer positioned to contact the body section within said tubular casing opposite said flange section; and a fuse link connector extending through said washer towards said second terminal and forming means to attach said washer to said body section;

said short circuit fuse link second end contacting said washer.

12. The cartridge of claim 11 wherein said open bore has at least a portion thereof which is frusto-conical.

13. The fuse link of claim 12 wherein the open bore has at least one section being substantially cylindrical.

14. A cartridge fuse comprising:

a tubular casing, said tubular casing being an electrical insulating material, and said tubular casing having a proximal end and a distal end;

a first terminal attached to said proximal end of said tubular casing;

a second terminal attached to said distal end of said tubular casing;

a short circuit link having a first end and a second end, said first end being electrically attached to said second terminal;

a solder alloy overload fuse link, said overload fuse link having a body with an upper section and a body section, said upper section being electrically attached to said first terminal, an insulator inside said tubular casing separating said body section from said short circuit fuse link;

a fuse link connector extending from said body section through said insulator towards said second terminal; and said short circuit fuse link second end electrically attached to said fuse link connector, wherein when there is an overload current, said fuse link connector electrically separates from said body section.

15. The cartridge fuse of claim 7 wherein said short circuit fuse link is ribbon-like having a width less than the inner diameter of said tubular casing;

said overload fuse link and connector are one-piece, said overload fuse link has an upper flange section, said flange section resting on the proximal end of the tubular casing, said flange section being electrically attached to said first terminal, said body section being spaced from the innerwalls of said tubular casing for a substantial length thereof;

said insulator is a washer having a diameter substantially equal to the inner diameter of said tubular casing, said washer positioned to contact the body section within said tubular casing opposite said flange section; and a fuse link connector extending through said washer towards said second terminal and forming means to attach said washer to said body section;

said short circuit fuse link second end contacting said washer.

* * * * *